US005978634A

United States Patent [19]

Sato et al.

[11] Patent Number: 5,978,634

[45] Date of Patent: Nov. 2, 1999

[54] DEVELOPMENT METHOD, DEVELOPMENT DEVICE, AND IMAGE FORMING APPARATUS THEREWITH

[75] Inventors: Kazuhiko Sato; Keiichiro Suzuki, both of Hachioji, Japan

[73] Assignee: Konica Corporation, Tokyo, Japan

[21] Appl. No.: 09/133,264

[22] Filed: Aug. 13, 1998

[30] Foreign Application Priority Data

Aug. 21, 1997 [JP] Japan ..... 9-224865

[51] Int. Cl.[6] ..... G03G 15/09

[52] U.S. Cl. ..... 399/277; 399/267; 399/272; 399/273; 399/274

[58] Field of Search ..... 399/267, 277, 399/273, 274, 272

[56] References Cited

U.S. PATENT DOCUMENTS 4,774,543 9/1988 Yoshikawa et al. ..... 355/4
5,655,191 8/1997 Furuya et al. ..... 399/231
5,701,552 12/1997 Stephany et al. ..... 399/53
5,758,240 5/1998 Ito et al. ..... 399/267
5,799,234 8/1998 Furuya et al. ..... 399/277
5,832,350 11/1998 Kumasaka et al. ..... 399/282
5,860,049 1/1999 Kumsaka et al. ..... 399/267

*Primary Examiner*—Richard Moses
*Assistant Examiner*—Shival Virmani
*Attorney, Agent, or Firm*—Cantor Colburn LLP

[57] ABSTRACT

In a development device for developing an electrostatic latent image formed on an image bearing body, the development device includes: a developer bearing body for conveying a developer borne thereon to a developing area on the image bearing body; a plurality of magnetic poles provided inside the developer bearing body; a detaching magnetic pole including optional two adjoining poles of the plurality of magnetic poles which are arranged to have the same polarity as each other for forming a repulsive magnetic field to remove the developer on the developer bearing body; and a magnetic body provided in the vicinity of and spaced away from the detaching magnetic pole, for forming a repulsive magnetic field having the same polarity as that of the detaching magnetic pole.

12 Claims, 12 Drawing Sheets

DEVELOPMENT METHOD, DEVELOPMENT DEVICE, AND IMAGE FORMING APPARATUS THEREWITH

BACKGROUND OF THE INVENTION

The present invention relates to a development device provided in image forming apparatuses such as electrophotographic copiers, printers, facsimile machines, etc. and a development method, and specifically to a color image forming apparatus comprised of a plurality of development devices.

As development methods of an electrophotographic apparatus, have been known a normal development method employed in common electrophotographic copiers, etc. and a reversal development method employed in digital printers, digital electrophotographic copiers, etc. The reversal development method is a method in that generally, laser, LED, etc. are employed as a light source, and a latent image formed on an image bearing body (hereinafter referred to as a photoreceptor) by charging and exposure is developed employing a toner charged with the same polarity as that of the charge on the photoreceptor to obtain a toner image. For example, when a photoreceptor is negatively charged, the toner is negatively charged, and development is carried out utilizing the difference in potential generated by exposure, and a toner image is formed on the photoreceptor. After development, a transfer material is charged in opposite as of the toner employing a transfer device using corona discharging, etc. and the toner image on the photoreceptor is transferred onto the transfer material. Thereafter, the potential of the transfer material is lowered by AC corona discharging or DC corona discharging; adhesion between the transfer material and the photoreceptor is lowered; the transfer material is then separated from the surface of the photoreceptor, and the subsequent process follows.

In the conventional development device, a rotating developer material bearing device (development sleeve) is arranged adjacent to a rotating photoreceptor. The development sleeve is formed in a hollow cylindrical shape, and is housed in a housing with an opening in the side facing the above-mentioned photoreceptor. In the development sleeve, development bias voltage with which AC voltage of 2,700 volts and 8,000 Hz are superposed is applied to DC voltage of −650 volts. The developer material bearing body comprises a fixed magnet in the interior and the circumferential surface bears a two-component developer material prepared by mixing toner particles with magnetic granules (carrier).

The development device is composed of a development unit housing loading a two-component developer material comprised of the above-mentioned toner and carrier, a development sleeve as a developer material transport means with a magnetic field generating means (magnet roll) comprising a fixed magnet in the interior, a developer material supply roller (hereinafter, referred to as supply roller), a developer material layer regulating member, which regulates the thickness of the developer material layer on the above-mentioned development sleeve, and a developer material stirring screw (stirring screw). In the toner supply opening section which is opened in the upper position of the above-mentioned development unit housing, the toner supplied from a toner cartridge to the interior of the above-mentioned development unit housing is stirred and mixed with the developer material loaded into the above-mentioned development unit housing to prepare the toner uniform in concentration and the resulting toner is supplied onto the circumferential surface of the above-mentioned development sleeve.

Of the developer materials on the development sleeve, the toner is only employed for development in the development range of an image bearing body (photoreceptor), and depending on an image pattern, the hysteresis of an image remains on the development sleeve. Irrespective of developing an image pattern having the same image and density, the image defect occasionally causes a density difference termed "ghosting". The conventional technique to minimize this ghosting is a rubber material termed a scraper, which is brought into contact with the development sleeve and the image hysteresis is eliminated by scraping the developer material from the development sleeve after development to minimize the ghosting problem.

However, in the conventional scraper method in which the scraper is in contact with the development sleeve, several problems are caused such that the developer material is not perfectly removed by the contact of the development sleeve with the scraper; the results are a deterioration of the developer material when it is scraped, and scratches and abrasion on the development sleeve.

Furthermore, by adjoining the magnetic field of the development sleeve to a portion termed "detaching magnetic pole" having the same magnetic polarity as that of the development sleeve, the developer material can be detached to some extent from the sleeve in the repulsive magnetic field of the detaching magnetic pole. However, only by providing the detaching magnetic pole, the developer material cannot be perfectly detached from the development sleeve. By optimizing the detaching magnetic pole and peripheral processes, the ghosting is minimized fairly well. However, the result is unsatisfactory.

SUMMARY OF THE INVENTION

The present invention is accomplished to solve the foregoing problems. An object of the present invention is to provide a development method which not only minimizes the ghosting and enables the formation of quality images, but also minimizes the degradation of a developer material and the formation of abrasion on a development sleeve; and a development device and image forming apparatus therewith.

In a development method in a developing zone, in which a developer material bearing body bearing and transporting the developer material and an image bearing body face with each other, the development method of the present invention to achieve the above-mentioned object is characterized in that the above-mentioned developer material bearing body comprises a plurality of magnetic poles; of a plurality of the magnetic poles, two optional magnetic poles adjacent to each other are subjected to same polarity; while forming a repulsive magnetic field employing these adjacent magnetic poles having the same polarity, a magnetic body is provided in non-contact near a detaching magnetic pole which detaches the developer material on the developer material bearing body, and by forming a repulsive magnetic field having the same polarity as the above-mentioned detaching magnetic pole, the developer material is detached from the above-mentioned developer material bearing body.

Furthermore, in a development device comprising a developer material bearing body which transports the developer material to the development zone of an image bearing body, the development device of the present invention is characterized in that the above-mentioned developer material bearing body comprises a plurality of magnetic poles; of a plurality of the magnetic poles, two optional magnetic poles adjacent to each other are subjected to the same polarity, and while forming a repulsive magnetic field employing these adjacent magnetic poles having the same polarity, in non-contact state near the detaching magnetic pole which detaches the developer material from the developer material bearing body, a magnetic body is provided which forms the repulsive magnetic field having the same polarity as that of the above-mentioned magnetic field.

Furthermore, in an image forming apparatus in which an electrostatic latent image formed on an image bearing body is developed employing a charged toner conveyed onto a developer material bearing body of a development device, and a toner image, after development, is electrostatically transferred to the above-mentioned image bearing body or a transfer material passing a space between an intermediate transfer body and a transfer device, and the above-mentioned transfer material is separated from the above-mentioned image bearing body employing a separation device at the downstream side of the transfer device, the image forming apparatus of the present invention is characterized in that the above-mentioned developer material bearing body comprises a plurality of magnetic poles, and of a plurality of the magnetic poles, two optional magnetic poles adjoining with each other, are subjected to same polarity, and a repulsive magnetic field is formed employing the adjoining magnetic poles having the same polarity and an electrostatic latent image formed on the above-mentioned image bearing body is developed employing the development device provided with a magnetic body forming the repulsive magnetic field exhibiting the same polarity as that of the above mentioned detaching magnetic pole, in non-contact state, adjacent to the detaching magnetic pole which detaches the developer material on the developer material bearing body.

DETAILED DESCRIPTION OF THE PREFERRED EMBODIMENT

Prior to the description of the embodiment of the present invention, the constitution of a color printer which is an example of an image forming apparatus to which a plurality of development devices of the present invention are mounted and functions thereby are explained with reference to the sectional constitution view in FIG. 1.

This color printer is a color image forming apparatus employing a method such that each color toner image formed on an image bearing body is successively superimposed, and then, the resulting toner images are simultaneously transferred onto a recording sheet at a transfer zone to form a color image. Thereafter, employing a separation means, the recording sheet is separated from the surface of the image bearing body.

Figure 1:
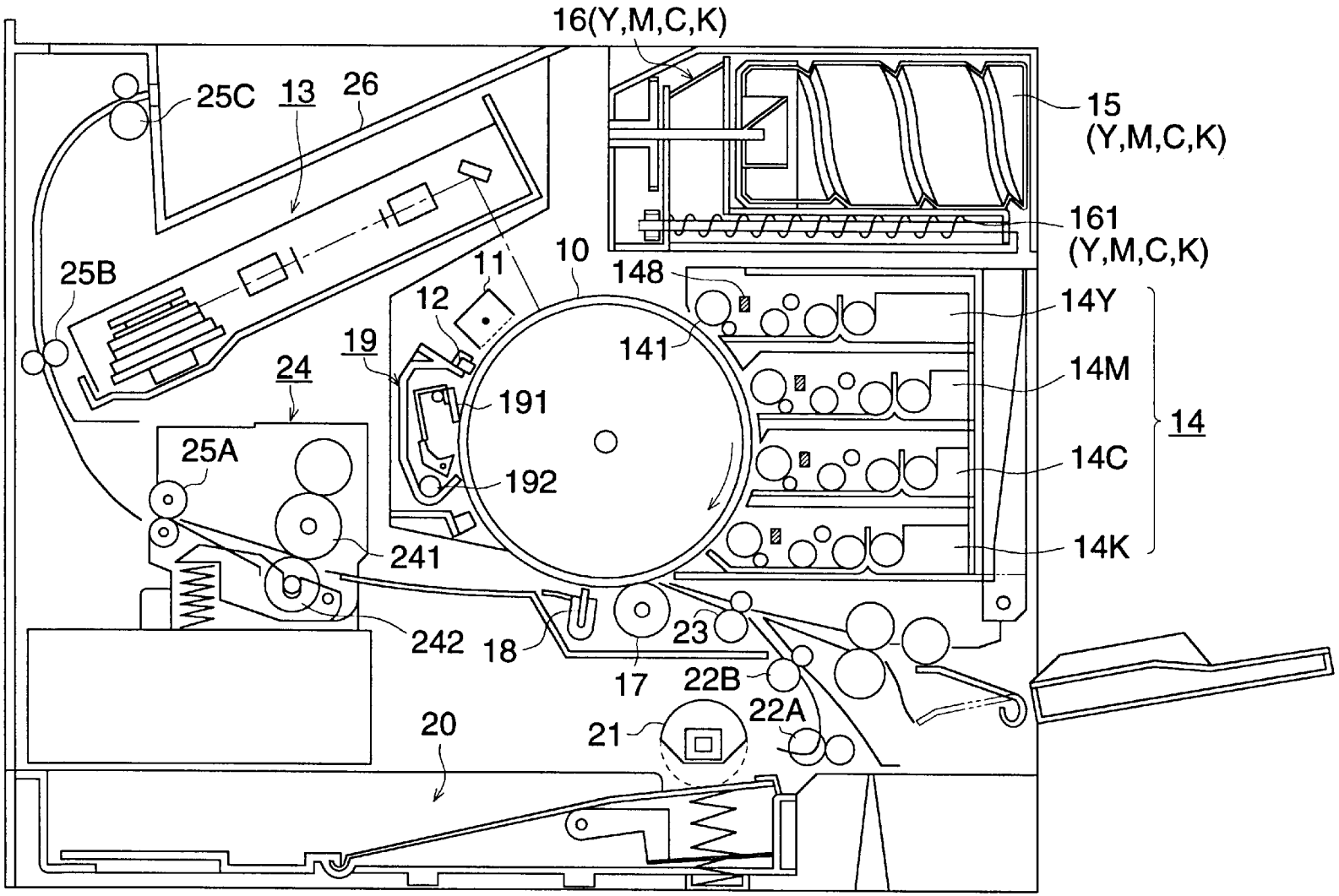
FIG. 1 is a sectional constitution view of a color printer which is one example of an image forming apparatus to which a plurality of the development devices of the present invention are mounted.

In FIG. 1, the reference numeral 10 is a photoreceptor drum which is an image bearing body. The photoreceptor drum is prepared by coating an OPC (organic photoconductive compound) photoreceptor on a drum base body and is drive-rotated in the clockwise direction as shown in FIG. 1 when being electrically grounded. The reference numeral 11 is a scorotron charging device and the circumferential surface of the photoreceptor drum 10 is subjected to uniform charging with high electrical potential $V_H$, by corona discharge generated by a grid maintained at a grid potential $V_G$ and a corona discharging wire. Prior to charging provided by this scorotron charging device 11, in order to eliminate the hysteresis of the photoreceptor up to the previous print, the circumferential surface of the photoreceptor is subjected to exposure by a pre-charging charge eliminating device (hereinafter referred to as PCL) 12 and is subjected to charge elimination. The above-mentioned photoreceptor hysteresis is referred to as an image pattern remaines on the photoreceptor, which was formed by charging and image exposure during preceding image formation, and is occasionally referred to as photoreceptor memory.

After uniform charging onto the photoreceptor drum 10, image exposure is carried out by an image exposure means in accordance with image signals. In the image exposure means 13, light emitted from a laser diode light source, not shown in FIG. 1, is transmitted via a rotating polygonal mirror, an fq lens, a cylindrical lens, and is deflected by a reflection mirror to carry out scanning. In accordance with the rotation of the photoreceptor drum 10, a latent image is formed. In the present embodiment, exposure is carried out for a character portion and a reversal latent image is formed so that exposed part potential $V_L$ is lower than charge potential $V_H$.

Around the photoreceptor drum 10, a development device 14 is provided which is composed of development units 14Y, 14M, 14C, and 14K which are loaded with two-component developer materials comprised of toners such as a yellow (y), magenta (M), cyan (C), black (K) and other toners and carriers, respectively.

At first, development employing the yellow toner as a first color is carried out employing a developer material bearing body 141 (hereinafter referred to as development sleeve).

The developer material is composed of carrier granules prepared by coating an insulating resin around ferromagnetic granules as the core, and toner particles prepared by mixing polyester powders as the main material with pigments corresponding to the required color, charge control agents, silica, titanium oxide, etc. The developer material is regulated to form a developer material layer with a thickness of 100 to 600 mm on the development sleeve 141, employing a developer material layer forming means mentioned below, and is conveyed to the development zone.

The space between the development sleeve 141 and the photoreceptor drum 10 in the development zone is regulated to the range of 0.2 to 1.0 mm which is greater than the developer material layer thickness and is subjected to an application of superposed AC bias $V_{AC}$ and DC bias $V_{DC}$. Because the DC bias $V_{DC}$, photoreceptor charged potential $V_H$ and the charge of a toner carry the same polarity, the toner which is provided with a chance to leave from the carrier by AC bias $V_{AC}$ is, when positively charged, is not adhered to the portion having the photoreceptor charge potential $V_H$ which is higher than the DC bias $V_{DC}$ but is adhered to the portion having exposed part potential $V_L$ lower than the DC bias $V_{DC}$, and image visualization (reversal development) is achieved.

After completing the image visualization of the first color, a magenta image forming process of the second color is initiated. The circumferential surface of the photoreceptor drum 10 is uniformly charged again by the scorotron charging device 11 and a latent image is formed according to the image data of the second color, employing the image exposure means 13. At this time, the charge elimination by PCL 12, which was carried out during the image forming process of the first color is not carried out because the toner adhered to the image part of the first color is scattered due to the rapid decrease in the surrounding electric potential.

In the photoreceptor in which the whole circumferential surface of the photoreceptor drum 10 is uniformly charged again at photoreceptor charge potential $V_H$, a part having no image of the first color is subjected to latent image formation and development in the same manner as in the first color. However, in the part having the image of the first color which is again subjected to the development, the latent image having a potential $V_M$, somewhat higher than the exposed part potential $V_L$, is formed and the development is carried out in accordance with the difference between DC bias $V_{DC}$ and potential $V_M$.

Regarding the cyan of the third color and the black color of the fourth color, image forming processes are carried out in the same manner as in the magenta of the second color, and four visualized images are formed on the circumferential surface of the photoreceptor drum 10.

A toner supplying device which supplies, under control, fresh color toners to each of the above-mentioned development units 14Y, 14M, 14C, and 14K is composed of a plurality of detachable cartridges 15 (Y, M, C, and K), toner storing means 16 (Y, M, C, and K), and toner transport means 161 (Y, M, C, and K).

On the other hand, a sheet of a transfer material (transfer sheet, etc.) ejected from a paper feeding cassette 20 via a woodruff roller 21 stops temporarily at the position adjacent to a register sensor via a pair of intermediate paper feeding rollers 22A and 22B. When transfer timing is adjusted, the sheet is fed to a transfer zone by the rotational operation of a pair of register rollers 23.

In the transfer zone, in synchronization with the transfer timing, a transfer means 17 which applies, to the circumferential surface of the photoreceptor drum, the voltage to transfer toner images is subjected to pressure contact, and the transfer material P is parted and a multi-color images are simultaneously transferred.

Subsequently, the transfer material P is subjected to charge elimination employing the separation means 18 such as a saw tooth electrode, etc.; is separated from the circumferential surface of the photoreceptor drum 10; is conveyed to a fixing device 24; is heat pressed employing a heat roller (upper roller) 241 and a pressure roller (lower roller) 242 to melt fix the toner image and is ejected onto a paper ejection tray 26 via a pair of paper ejection rollers 25A, 25B and 25C. Further, after the transfer material passes, the transfer means 17 is kept from detaching from the circumferential surface and is ready for the formation of the subsequent toner image.

On the other hand, the photoreceptor drum 10 from which the transfer material P is separated is subjected to removal and cleaning of the residual toner through pressure contact of the blade 191 of a cleaning device 19; which is subjected again to charge elimination by the PCL 12 and charging by the scorotron charging device 11, and is subjected to subsequent image forming process. Further, immediately after the blade 191 cleans the photoreceptor surface, it withdraws from the circumferential surface of the photoreceptor drum 10. The toner waste which is scraped into the interior of the cleaning device 19 is ejected by a screw 192 and is then stored in a toner waste recovery vessel not shown in the figure.

A plurality of the above-mentioned development units 14Y, 14M, 14C, and 14K have almost the same constitution. Accordingly, the development device 14 is employed in the following explanation, as the representative of these devices.

Figure 2:
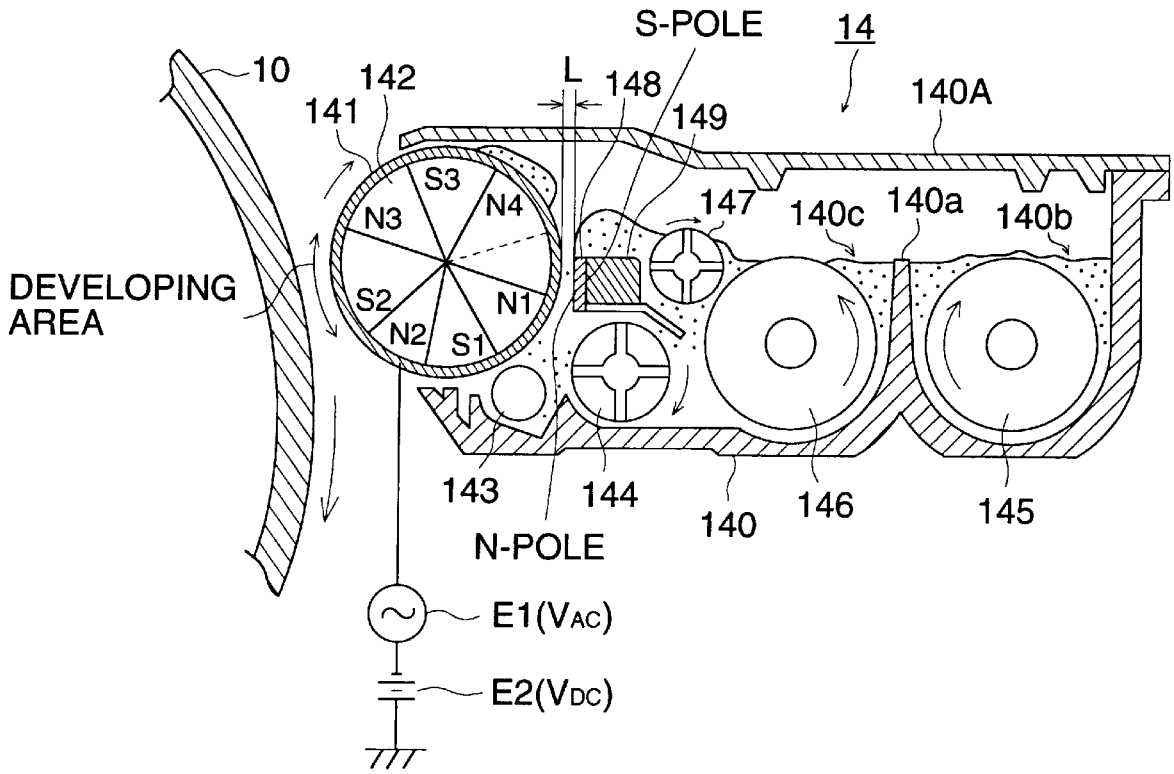
FIG. 2 is a sectional view of the development device of the present invention.

FIG. 2 is a sectional view of the development device 14 of the present invention. In FIG. 2, the reference numeral 140 is a development unit housing which accepts a two-component developer material comprised of toner particles and carrier granules; 141 is a development sleeve, as a developer material conveying means, having a magnetic field generation means (magnet roll) comprising a fixed magnetic body in the interior; 143 is a developer material layer thickness regulating member which regulates the developer material layer thickness on the development sleeve 141 to the desired value; 144 is a developer material supplying roller (hereinafter referred to as supplying roller) in a paddle shape which supplies the developer material to the development sleeve 141; 145 and 146 are developer material stirring screws (hereinafter referred to as stirring screw). Further, E1 is a AC power source and E2 is a DC power source. Furthermore, arrow marks in the figure show rotational directions of each roller and the photoreceptor drum.

The stirring screws 145 and 146 are arranged parallel in the first stirring chambers 140*b* and the second stirring chamber 140*c*, respectively, which are formed in both sides of a partition 140*a* erected from the base portion, and are rotated in the opposite direction each other. The upper part of the first stirring chambers 140*b* and 140*c* are covered with a ceiling plate 140A.

The toner supplied from the toner cartridge 15 via the toner storing means 16 and the toner transport means 161 is inserted in the first stirring chamber 140*b* through a toner supply opening (not shown) opened in the ceiling plate 140A for the supply.

The reference numeral 147 is a paddle shaped developer material transport roller (hereinafter referred to as transport roller) which transports the developer material on the development sleeve 141 after development to the stirring screw 146.

In the development sleeve 141, a magnet roll 142 is fixedly arranged in which a plurality of magnetic poles N1, N2, N3, N4, S1, S2, and S3 are alternately arranged. In the plurality of these magnetic poles, two optional poles, for example, N1 and N4 closely adjacent to each other, are arranged so as to exhibit the same polarity. A repulsive magnetic field is formed by the adjacent magnetic poles N1 and N4 having the same polarity (detaching magnetic pole) and thus, a detaching magnetic pole is formed which detaches the developer material on the development sleeve 141.

The outer diameter of the development sleeve 141 is preferably between 8 and 60 mm. When the outer diameter is not more than 8 mm, it is impossible to form the magnet roll 142 comprising of at least seven magnetic poles necessary for image formation N2, S2, N3, and S3, a magnetic pole S1 facing the developer material layer thickness regulating member 143, and detaching magnetic poles N1 and N4.

Furthermore, when the outer diameter is not less than 60 mm, a development device increases in size. Particularly, in a color image forming apparatus (refer to FIG. 1) comprising a plurality of sets of development devices (for example, 14Y, 14M, 14C, and 14K development units), the developing apparatus 14 increases in size and thus, the outer diameter of the photoreceptor drum 10 increases. Furthermore, after the transfer to a transfer material and charge elimination, it becomes difficult to carry out curvature separation. Still more, the image forming apparatus increases in size due to increase in size of the development device 14 and the photoreceptor drum 10.

Further, as the image forming apparatus according to the present invention, a modified Konica KL-2010 Color Printer (manufactured by Konica Corp.) is employed, having the outer diameter of the development sleeve 141 is 18 mm and the outer diameter of the photoreceptor drum 10 is 100 mm.

Figure 3:
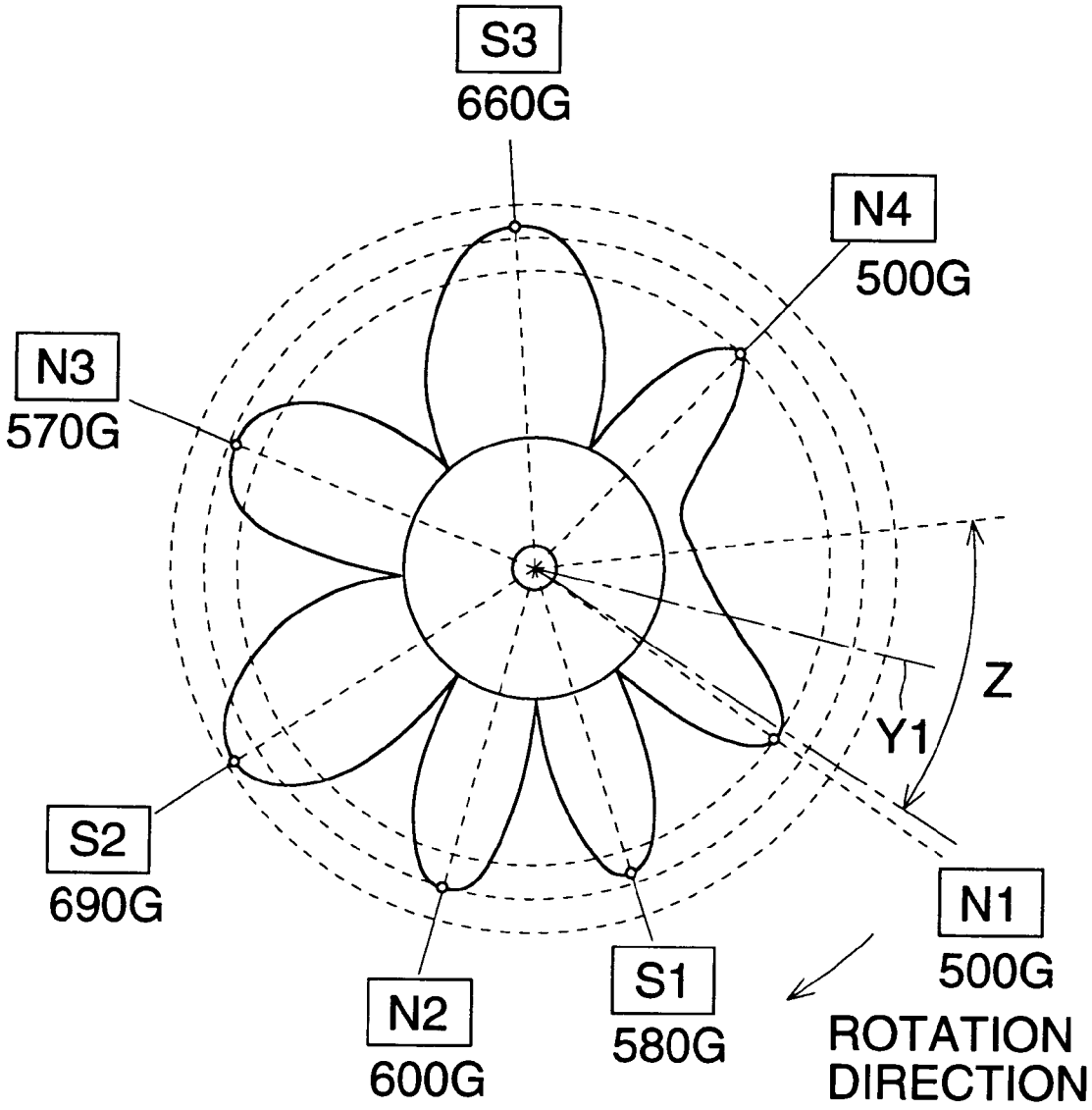
FIG. 3 is a view showing the magnetic force distribution of a magnet roll.

FIG. 3 shows the magnet force distribution of the magnetic roll 142. When a non-magnetic development sleeve 141 surrounding the outer circumference of the magnet roll 142 was rotated in the direction of arrow, it was practically measured that there was formed a portion to which almost no developer material is adhered due to the fact that the developer material on the development sleeve 141 was detached in a 40° angle range Z adjacent to the magnetic pole N1 to the upstream side on the rotational direction by a repulsive magnetic field formed by magnetic poles N1 and N4. However, it was found that it was impossible to perfectly detach the developer material on the development sleeve 141 only by the repulsive magnetic field formed by the magnetic poles N1 and N4.

In the present invention, the magnetic body 148 is arranged to form a repulsive magnetic field having the same polarity as those of magnetic poles N1 and N4 at the predetermined position adjacent to, in non-contact with, the development sleeve 141 near magnetic poles N1 and N4 forming the above-mentioned detaching magnetic pole. Namely, the N pole of the magnetic body 148 is arranged, while facing magnetic poles N1 and N4, and forms a repulsive magnetic field. A predetermined clearance L is maintained between the N poles of the magnetic body 148 and the circumferential surface the development sleeve 141. The reference numeral 149 is a holder which holds the magnetic body 148 and fixes it to the predetermined position of the development unit housing 140.

Figure 4:
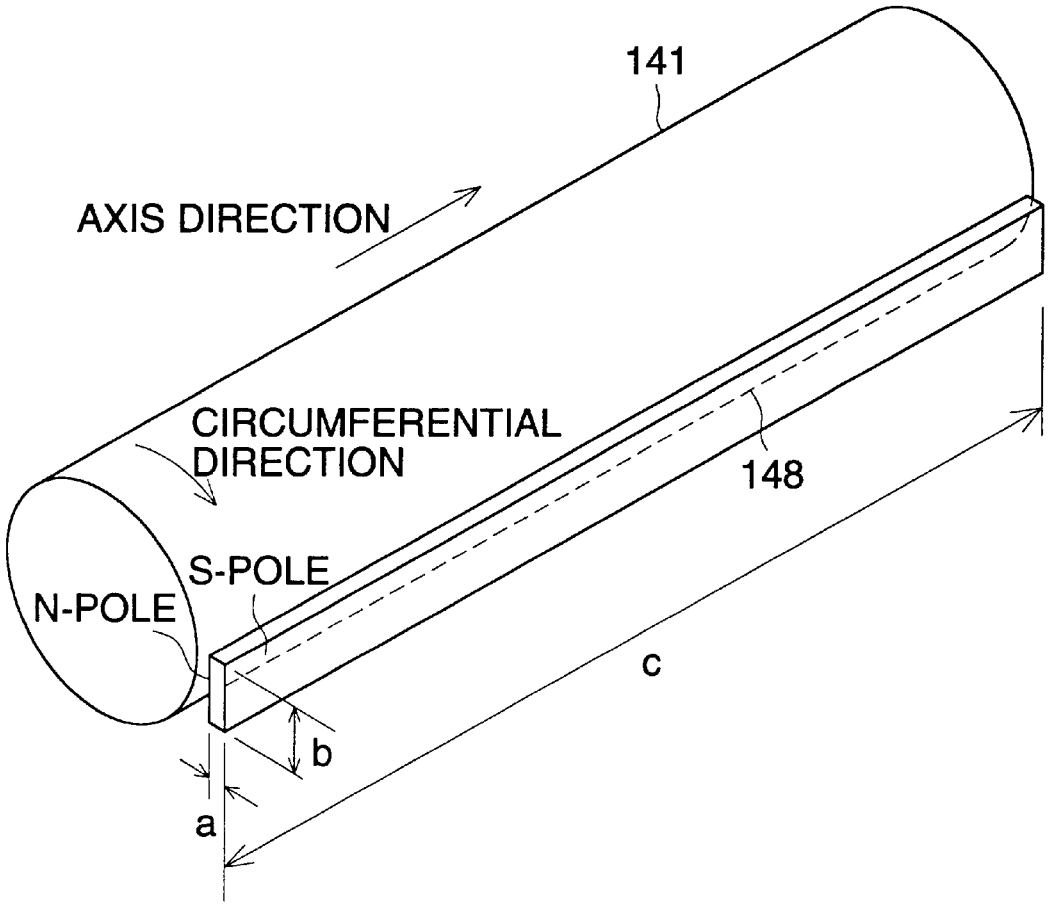
FIG. 4 is a perspective view showing the arrangement of a development sleeve and a magnetic body.

FIG. 4 is a perspective view showing the arrangement of the development sleeve 141 and the magnetic body 148.

EXAMPLES

The examples of the development device according to the present invention is explained below.

As the magnetic body 148, a ferrite series rubber BQC14 (manufactured by TDK Corp.) was employed to obtain excellent effects. The material properties of RQC14 are shown below.

Remanent magnetic flux density: 2,400±100 G

Coercive field strength: $H_{cB}$ 179 ± 16 kA/m $H_{cJ}$ 310 ± 28 kA/m

Further, roughly the same results are obtained by employing: ferrite series rubber (BQJ05, BQA14, BQE14, BQK12) other than the above-mentioned ferrite series rubber BQC14, neodymium, iron, boron series rare earth cobalt magnet (NEOREC magnet series), composite magnet (magnetic body) such as ferrite magnet wet process anisotropy material series (FB series), etc. Further, the above-mentioned various magnetic materials are all manufactured by TDK Corp. However, magnetic body materials, if they have the desired remanent magnetic flux density, coercive field strength, and maximum energy product, are not limited to the above-mentioned materials.

Specifications of the magnetic body composed of the ferrite series Raba BQC14 are shown below (refer to FIG. 4).

Thickness "a" (length between magnetic poles N and S)=1 mm

Height "b"=4 mm

Figure 5:
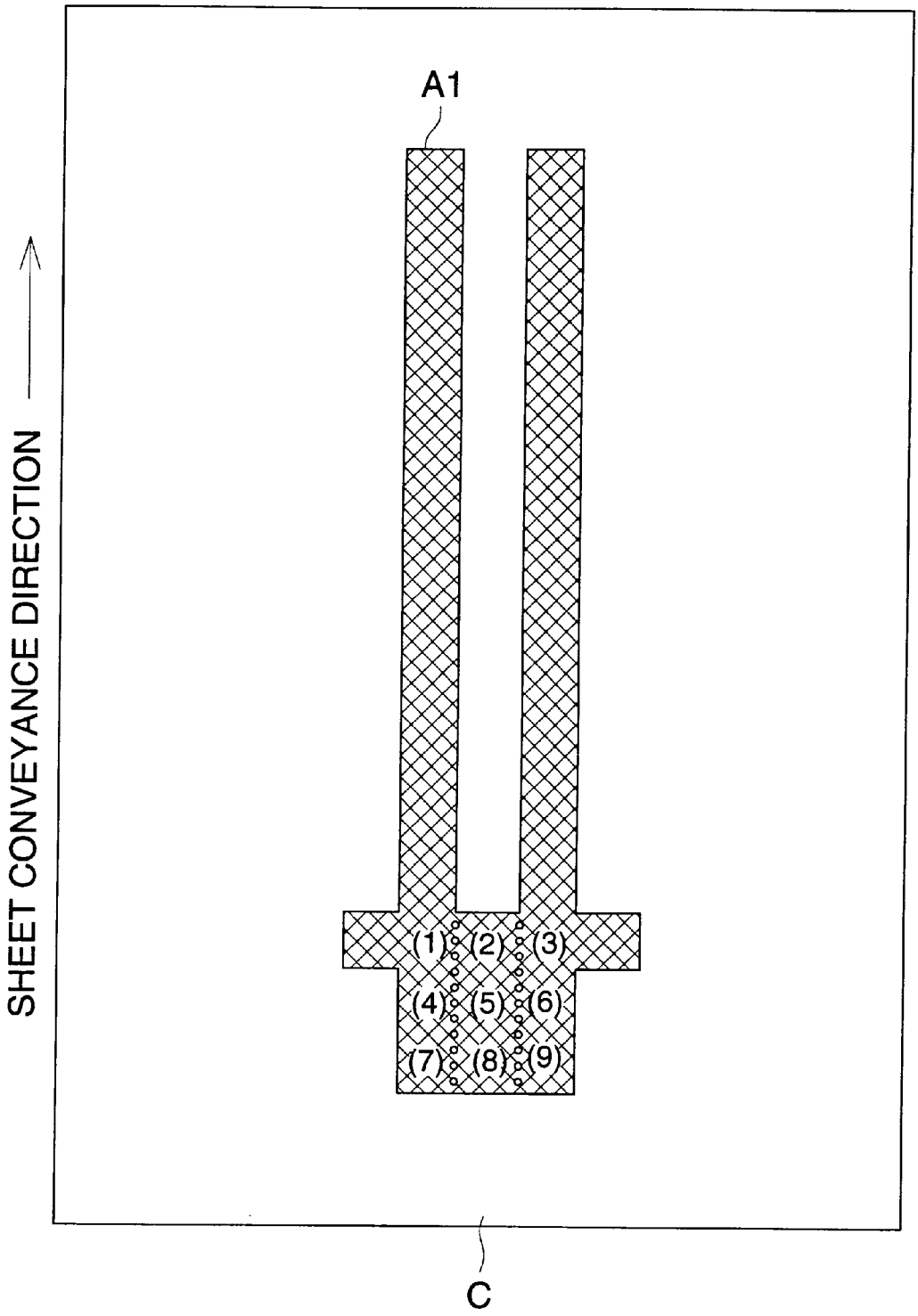
FIG. 5 is an illustration showing an image pattern to evaluate ghosting.

Width "c" (length parallel to axis direction of development sleeve 141)=300 mm FIG. 5 shows an image pattern for evaluating ghosting. This pattern was prepared by a signal generating device for image formation. The cross-hatched portion shown in FIG. 5 is of solid black portions A1 and A2 exhibiting a reflection density of about 1.4. The slanted portion is a half tone portion B, and the white portion is C.

The above-mentioned image pattern for evaluating ghosting was printed, using a black developer material, while employing a modified Konica KL-2010 Color Printer (manufactured by Konica Corp.), and the density of the pattern formed onto a transfer material was measured by a Macbeth Reflection Densitometer (manufactured by Macbeth Co.).

References (1), (2), (3), (4), (5), (6), (7), (8), and (9) shown in FIG. 5 show portions to measure reflection densities in the solid black portion A1. The center portions (2), (5), and (8) acquire the sufficient image density during development because in the white portion developed previously, no developer material was consumed. However, in the left portions (1), (4), and (7), and the right portions (3), (6), and (9), the image density decreases during development because in the black portion, which was developed previously, a large amount of the developer material is consumed. Accordingly, each of the image densities of the left portions (1), (4), and (7), and the right portions (3), (6), and (9) becomes lower than that of the center (2), (5), and (8), is subjected to density difference to form images with a lower density.

The images resulting in these density differences are termed ghosting.

Subsequently, evaluation on the image density difference is described below.

(Evaluation A) Evaluation of density difference on the solid black portion A1

$$\left\{\left((2)-\frac{(1)+(3)}{2}\right)+\left((5)-\frac{(4)+(6)}{2}\right)+\left((8)-\frac{(7)+(9)}{2}\right)\right\}\div 3$$

Figure 6:
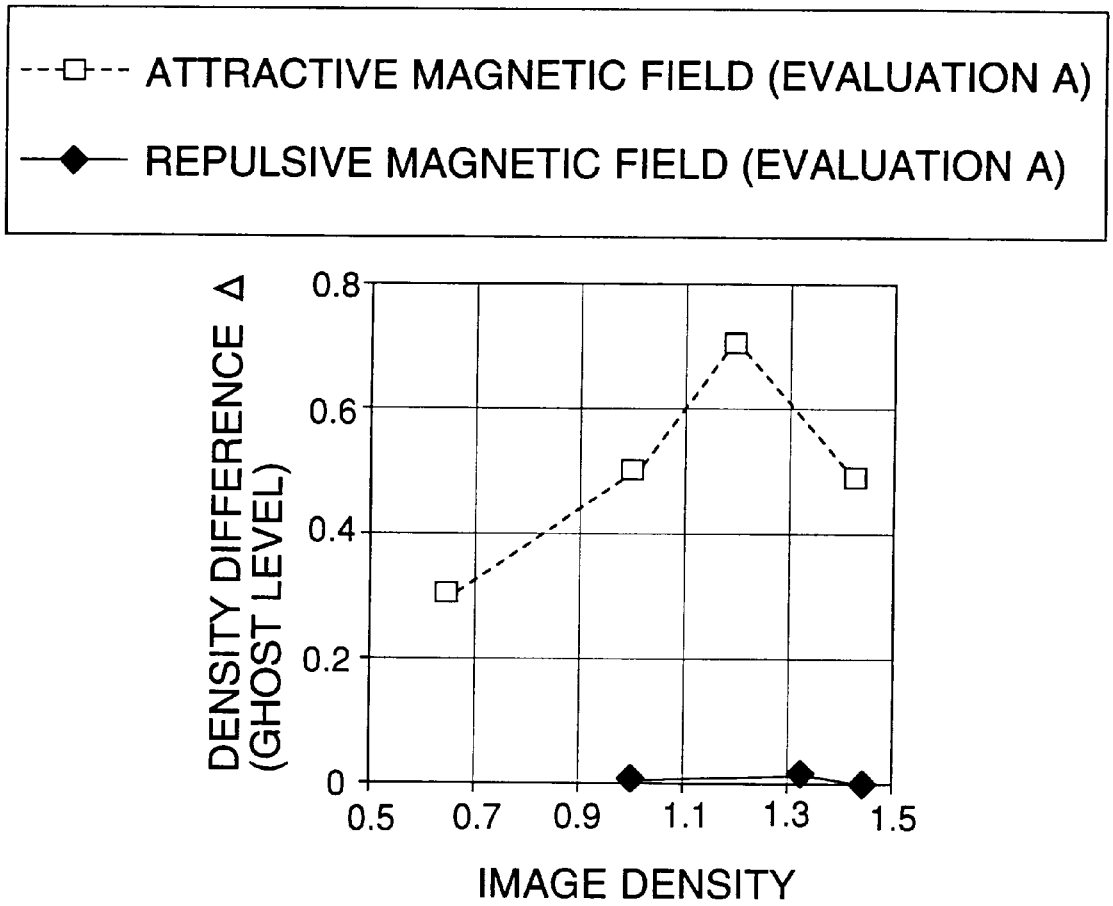
FIG. 6 is a graph showing the difference in characteristics between a case in which the magnetic field direction of a magnetic body is arranged in a repulsive magnetic field against a detaching magnetic pole for a magnet roll and a case in which it is arranged to be a mutually attractive magnetic field.

FIG. 6 shows the difference in characteristics between a case in which when the above-mentioned magnetic body 148 is arranged in non-contact near the development sleeve 142, the magnetic field direction is arranged in a repulsive magnetic field against detaching magnetic poles N1 and N4 and a case in which it is arranged in an attractive magnetic field.

When arranged in the attractive magnetic field, the strength of the repulsive magnetic field decreased and Evaluation A resulted in a large image density difference to cause ghosting. On the other hand, when arranged in the repulsive magnetic field, the strength of the repulsive magnetic field increased due to synergetic effect of the detaching magnetic poles N1 and N4 with the magnetic body 148, and Evaluation A resulted in almost no image density difference to cause no ghosting. Thus excellent effect was obtained.

The value (density) of the X axis in FIG. 6 shows the image density of the (5) portion of the solid black portion A1 of the image pattern shown in FIG. 5 among density-measured image samples, and during outputting images, the value (density) of the X axis is changed by changing the development AC bias.

The value (density) of the X axis in FIG. 8 described below also shows the image density of the (5) portion of the solid black portion A1 of the image pattern shown in FIG. 5 among density-measured image samples.

Figure 7:
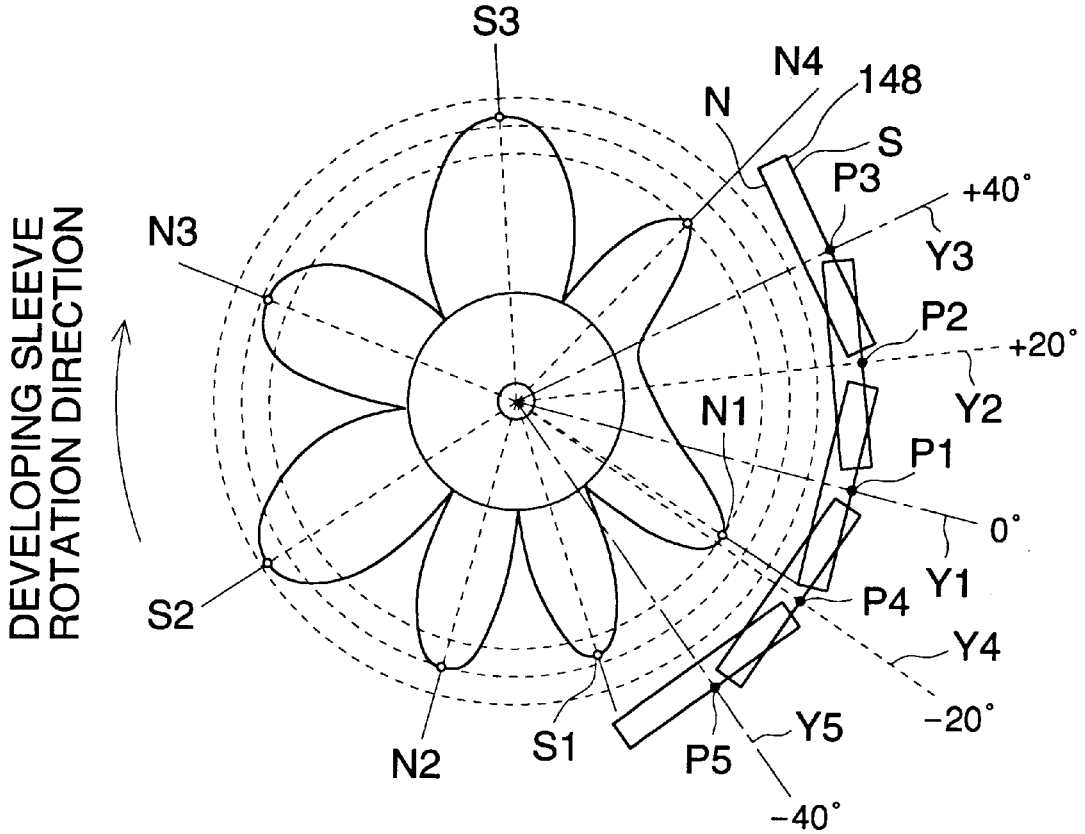
FIG. 7 is a chart to check an arrangement position of a magnetic body against a detaching magnetic pole for a magnet roll.

FIG. 7 is a chart to check the arrangement position of a magnetic body 148 against detaching magnetic poles N1 and N4 of the magnet roll 142. FIG. 8 is a characteristic graph to check image density difference corresponding to the arrangement position of the magnetic body 148.

The employed development sleeve 141 is a base body made of an aluminum alloy having a diameter of 18 mm.

When the development sleeve 141 is rotated clockwise shown in FIG. 3, a reference line Y1 of equally divided angle in an area Z in which a developer material is not adhered onto the development sleeve shown in FIG. 3 is set at 0°. When at the position of this reference line Y1, the magnetic body 148 is provided in non-contact with the development sleeve 141, the image density difference D of the image density after the image formation employing the above-mentioned image pattern for evaluating ghosting is excellent because maximum density difference D=0.02 or less as shown in a line graph P1 in FIG. 8.

Further, the area Z in which the developer material is not adhered on the development sleeve 141 is defined as follows. A two-component developer material is adhered onto adhesive tape and the amount of the developer material adhered onto the adhesive tape is measured. Then, the area is defined as that having a weight of 0.5 mg/cm$^2$ or less.

Figure 8:
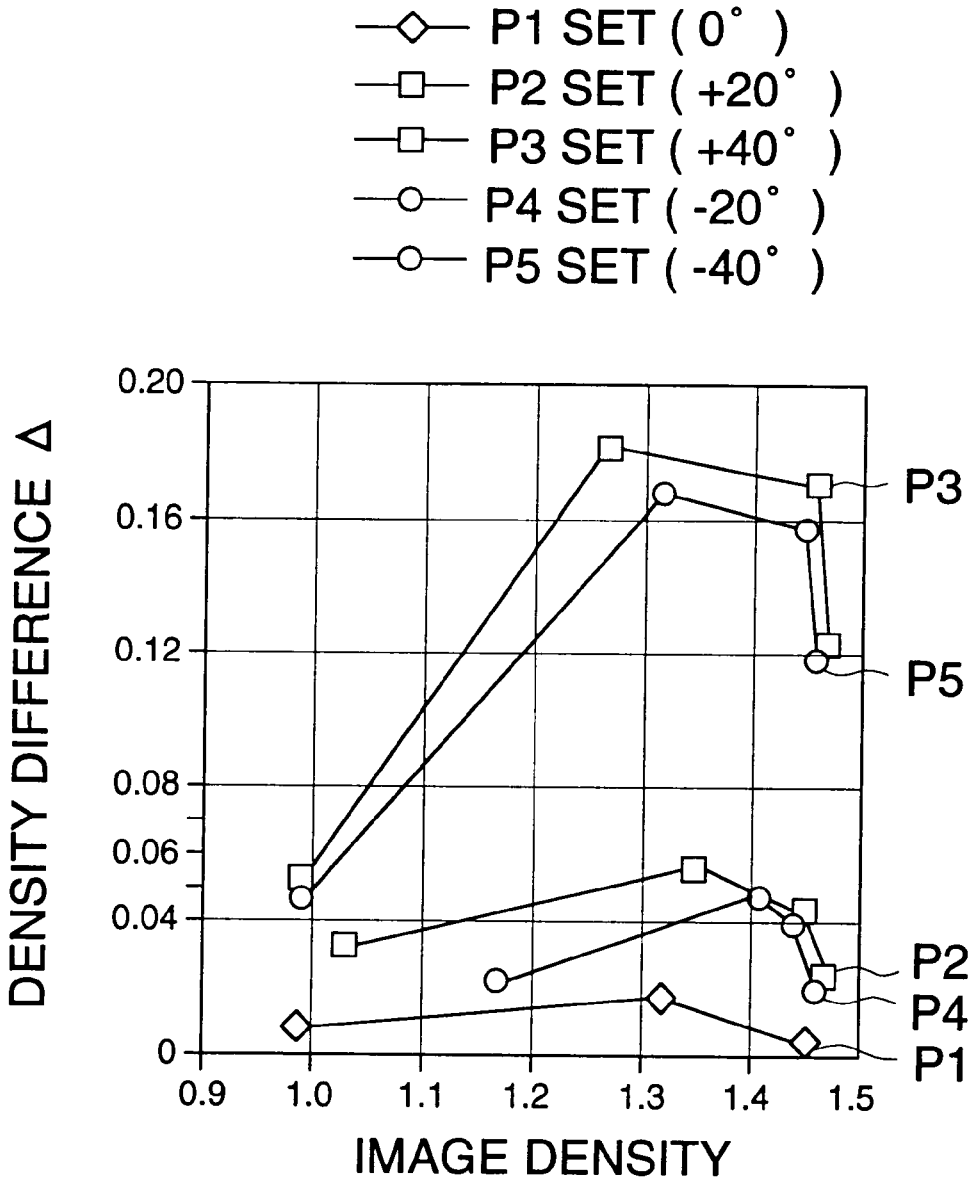
FIG. 8 is a characteristic graph to check the image density difference due to an arrangement position of a magnetic body.

When the magnetic body 148 is provided by deviating, from the reference line Y1, +20° upward (Y2) and −200 (Y4) downward, as shown by line graphs P2 and P4 in FIG. 8, the maximum density difference D=0.06 or less was rated good. Regarding the ghosting evaluation rate, the maximum density difference D=0.06 or less is rated good because the density difference is not visually recognized. Accordingly, though the magnetic body is provided upon deviating by ±20° from the detaching position of the reference line Y1, the maximum density difference is in the tolerance range.

When the magnetic body is provided upon deviating by ±40° from the detaching position of the reference line Y1, as shown by line graphs P3 and P5 in FIG. 8, the maximum density difference D=0.19 is not accepted.

Further, the examined closest distance between the magnetic body and the detaching pole under examination was 1 mm, while the preferred distance is between 0.1 and 3.0 mm. Furthermore, the examined magnetic flux density of an N4 (upper) pole and an N1 (lower) pole in the sleeve detaching poles was 500 G, while the preferred magnetic flux desnity is between 300 and 1,000 G.

The examined residual magnetic flux density of a magnetic body was 2,400 G, while the preferred residual magnetic flux density is between 1,000 and 7,000 G.

The examined carrier magnetization of a developer material employed was 50 emu/g, while the preferred magnetization is between 20 and 80 emu/g.

Each of optimized design values varies somewhat depending on the magnetic flux density of a sleeve, the residual magnetic flux density of a magnetic body, and the distance between the sleeve and the magnetic body. However, when set at the preferred range, effects are exhibited. Furthermore, examined conditions are almost equal to the optimum values.

Figure 9:
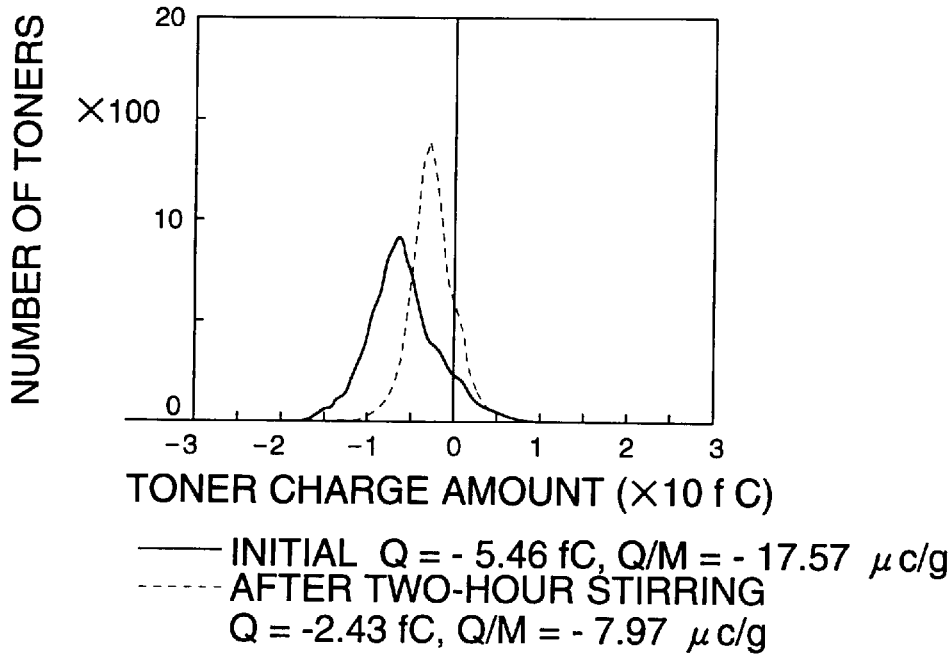
FIGS. 9(*a*) and 9(*b*) are characteristic graphs showing test results on a developer material degraded by developer material detaching means of a conventional scraper-type method and the magnetic body method of the present invention.
Figure 9:
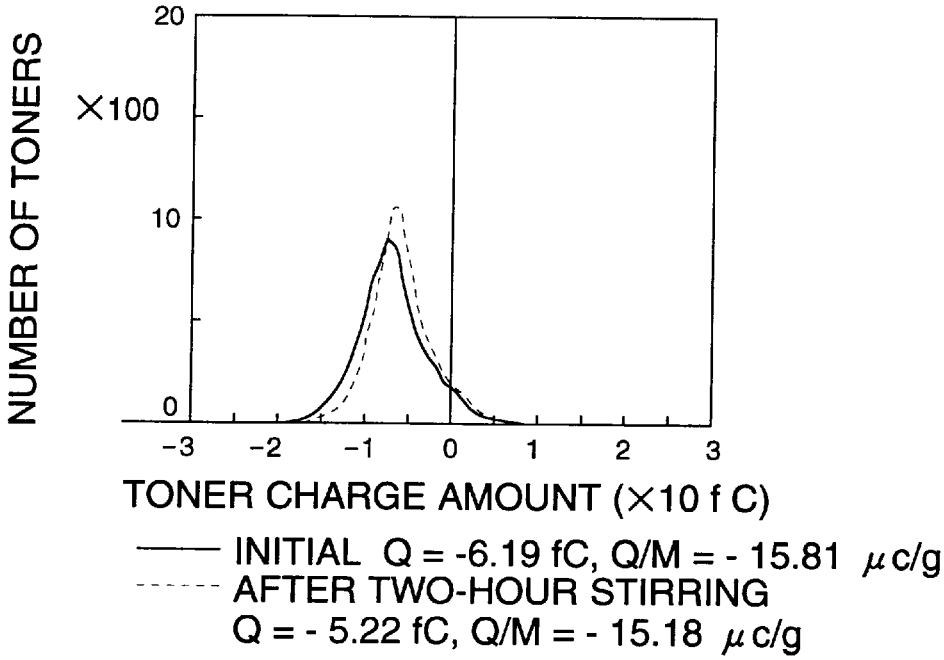

FIG. 9(*a*) is a characteristic graph showing developer material degradation test results obtained by a development device having a conventional scraper type developer material detaching means.

In this conventional technique, the developer material is detached from the development sleeve 141 employing a contact member (scraper). Therefore, by a single body stirring and image printing, remarkable variations on charge distribution in the developer material, charge amount Q, charge amount Q/M, etc. as shown below were caused due to the degradation of the developer material. In FIG. 9(*a*), the solid line shows the initial toner charge amount (fC) and the short dashed line shows the toner charge amount (fC) after two hours of stirring. Average charge amount Q (fC) and charging amount Q/M (mc/g) vary after two hours of stirring as shown below.

Average charge amount Q (fC) Initial: −5.46, After two-hour stirring: −2.43

Charging amount Q/M (mc/g) Initial: −17.57, After two-hour stirring : −7.97

Further, the charge distribution, charge amount Q, and charging amount Q/M of the developer material were measured employing an E-Spart Analyzer (manufactured by Hosokawa Micron Co.).

FIG. 9(*b*) is a characteristic graph (solid line) showing the developer material degradation test results obtained by employing a developer material detaching type development device in which the magnetic body 148, according to the present invention, is provided with the development sleeve 141 in non-contact.

In this technique, the developer material is detached without contacting from the development sleeve 141 employing the magnetic body 148. Therefore, by single body stirring and image printing, developer material degradation is hardly caused and charge distribution, charge amount Q, charging amount Q/M, etc in the developer material exhibit minimum variation as shown below. These results show that this technique is effective to stabilize development properties and achieve high durability. Further, the solid line in FIG. 9(*b*) shows the initial toner charge amount (fC) and the short dashed line shows the toner charge amount after two-hours stirring. The above-mentioned machine was employed for measurements.

Average charge amount Q (fC) Initial: −6.19, After two-hour stirring: −5.22

Charging amount Q/M (mc/g) Initial: −15.81, After two-hour stirring : −15.18

Further, in the above example, the black developer material is described (ghosting evaluation pattern in FIG. 5). However, similar effects are obtained regarding other color developer materials (Y, M, C) by providing the magnetic body of the present invention which faces the development sleeve without contact.

Particularly, during color development, by stabilized developer material detaching of the present invention, stabilized charge distribution, charge amount Q, charging amount Q/M are obtained, and during multicolor superimposed development, excellent images without color contamination are obtained. Further, the development of the present invention is not limited to a color image forming device, but may be adapted to a single color image forming device having a single development device.

Figure 10:
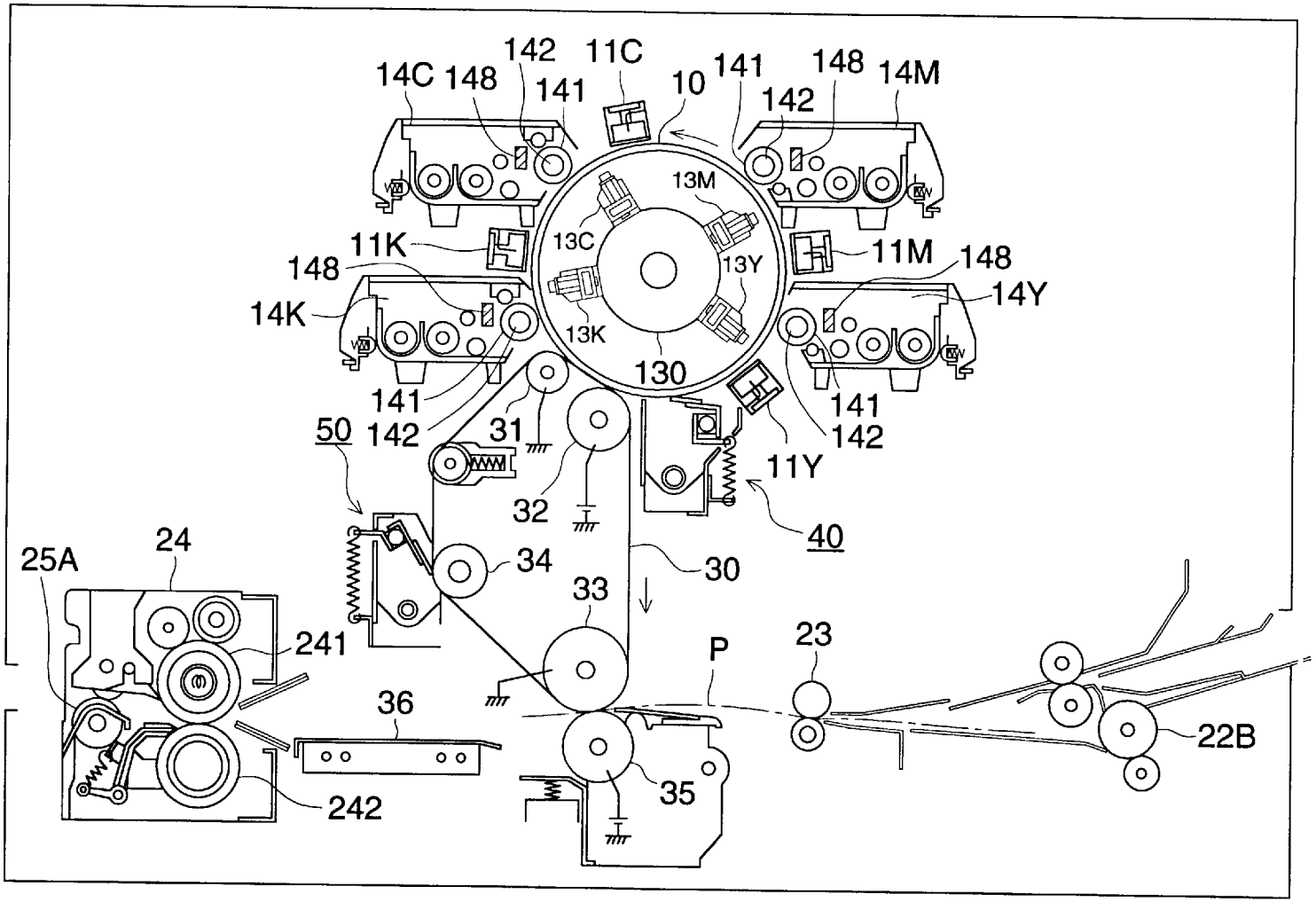
FIG. 10 is a sectional constitution view showing another embodiment of a color image forming apparatus to which the development device of the present invention is applied.

FIG. 10 is a sectional constitution view showing another embodiment of a color image forming apparatus to which the development device of the present invention is applied.

Further, regarding the reference numeral used in FIG. 10, the part having the same function as that in FIG. 1 is termed the same reference numeral. Furthermore, points different from the above-mentioned embodiment are explained.

The photoreceptor drum 10 which is a drum shaped image bearing body is prepared by, for example, providing a cylindrical transparent resin base body formed by a transparent member composed of transparent acrylic resin in the inner side and forming a transparent conductive layer and an organic photosensitive layer (OPC) on the circumferential surface of the above-mentioned base body, and is rotated in the direction of arrow shown in FIG. 10, while being electrically grounded.

The color image forming apparatus according to the present invention is that around the image bearing body 10, are provided a plurality of image forming assemblies (four assemblies shown in FIG. 10) composed of a charging means, an image exposure means, and a development means.

References 11Y, 11M, 11C, and 11K are scorotron charging devices (hereinafter referred to as charging device 11 (Y, M, C, K)), which provide a uniform charge to the photoreceptor drum 10 employing corona discharging, generated by a grid kept at the predetermined potential against the organic photoconductive layer of the photoreceptor drum 10, and a discharge wire.

References 13Y, 13N, 13C, and 13K are image exposure means (hereinafter referred to as exposure optical system 13 (Y, M, C, and K), which is composed of LED arranged in the axis direction of the photoreceptor drum 10 and a Selfoc lens as a size-for-size focusing system, and image signals of each color read by a image reading device as a separate body are successively outputted from the memory and inputted into each of the above-mentioned exposure optical systems 13 (Y, M, C, and K) in the form of electrical signals and a latent image is formed in accordance with the rotation of the photoreceptor drum 10. Each exposure optical system 13 (Y, M, C, or K) which is mounted on a supporting member 130, provided as an optical system supporting means, is accommodated in the interior of base body of the above-mentioned photoreceptor drum 10.

References 14Y, 14M, 14C, and 14K are development units loading yellow (Y), magenta (M), cyan (C), and black (K) developer material, respectively, and each of them is provided with the development sleeve 140, the magnet roller 142 comprising a detaching magnetic pole, and the magnetic body 148, each of which rotates along the circumferential surface of the photoreceptor drum 10, while keeping a predetermined space from the surface.

An electrostatic latent image formed on the photoreceptor drum 10 by charging employing the above-mentioned charging devices 11 (Y, M, C, and K) and image exposure employing the exposure optical systems 13 (Y, M, C, and K) are subjected to reversal development in non-contact state by the application of development bias voltage employing each of the above-mentioned development units 14 (Y, M, C, and K).

In an image reading device provided separately from this device, the image on an original document is read employing an imaging element or edited employing a computer, and the read or edited image is temporarily stored in a memory as image signals which are classified to each color of Y, M, C, and K.

In accordance with the initiation of image recording, the photoreceptor drum 10 is rotated counterclockwise (in the direction of arrow shown in FIG. 10) by the start of a photoreceptor drive motor, and at the same time, the application of potential to the photoreceptor drum 10 is initiated by the charging action of the charging device 11Y.

After the electric potential is applied to the photoreceptor drum 10, in the above-mentioned exposure optical system 13Y, exposure is initiated by the electrical signals corresponding to the image signal of the first color signals, that is, the yellow image signals, and an electrostatic latent image corresponding to the yellow image of the original document is formed on the surface of photosensitive layer by the rotational scanning of the drum.

The above-mentioned latent image is subjected to reversal development employing the development unit 14Y in such a manner so that the developer material on the development sleeve 140 is in a non-contact state, and in accordance with the rotation of the photoreceptor drum 10, a yellow (Y) toner image is formed.

Subsequently, the photoreceptor drum 10 is subjected to application of electric potential on the above-mentioned yellow (Y) toner image, employing the charging device 11M; is subjected to exposure, employing the electrical signals corresponding to the second color signals, that is, magenta (M) image signals, and is subjected to reversal development, in a non-contact state, employing the development unit 14M to superimpose the magenta (M) toner image on the above-mentioned yellow (Y) toner image.

In the similar manner, employing the charging device 11C, the exposure optical system 13C, and the development unit 14C, a cyan (C) toner image corresponding to the third color signals is formed upon superimposition, and furthermore, employing the charging device 11K, the exposure optical system 13K, and the development unit 14K, a black (K) toner image corresponding to the fourth color signals is successively formed upon superimposition. Within one rotation of the photoreceptor drum 10, color toner images are formed on the circumferential surface.

Exposure onto the organic photosensitive layer on the photoreceptor drum 10, employing each of these optical systems, is carried out for each of the above-mentioned wavelengths through the transparent base body from the inside of the drum. Accordingly, exposures corresponding to the second, third, and fourth color signals are carried out without being subjected to any effect of the previously formed toner images, and enable the formation of electrostatic latent images which are the same as that corresponding to the first color signals. Further, during development employing each of development units 14 (Y, M, C, and K), direct current or alternating current superposed direct current development bias is applied to the development sleeve 141, and non-contact development is carried out employing a one- or two-component developer material loaded in the development units 14 (Y, M, C, and K), and thus, non-contact reversal development is carried out for the photoreceptor drum 10 of which transparent conductive layer is electrically grounded.

The color toner images formed on the circumferential surface of the photoreceptor drum 10 are temporarily transferred to an intermediate transfer belt 30 provided as a intermediate transfer means.

The intermediate transfer belt 30 is an endless rubber belt having a thickness of 0.5 to 2.0 mm and is composed of two layers constituted by applying a 5 to 50 mm thick fluorine coating as a toner filming minimizing the layer to the outside of a semiconductive base body having a resistance of $10^8$ to $10^{12}$ W·cm composed of silicone rubber or urethane rubber. The intermediate transfer belt 30 is entrained about rollers 31, 32, 33, and 34, and is synchronously advanced clockwise with the circumferential speed of the photoreceptor drum by the driving force transmitted to the roller 34.

In the intermediate belt 30, the belt surface between rollers 34 and 32 is in contact with the circumferential surface of the photoreceptor drum 10; the belt surface of the circumferential surface of the roller 34 is in contact with the transfer roller 35 as a transfer member, and at each contact position, the transfer zone of a toner image is formed.

The color toner images composed of a plurality of colors, which are in an adhered state on the circumferential surface of the photoreceptor drum 10, is firstly transferred to the circumferential surface of the intermediate transfer belt 30 by the application of a bias voltage having polarity opposite to the toner to roller 32 at the position contacting the above-mentioned intermediate belt 30. Namely, the color toner images on the photoreceptor drum 10 are transported to the transfer zone without scattering the toner employing the guidance of the roller 31 electrically grounded and are efficiently transferred to the intermediate belt 30 by the application of 1 to 2 kV bias voltage to the roller 32.

A cleaning device is brought into pressure contact with the photoreceptor drum 10 and a cleaning device 50 is brought into pressure contact with the intermediate transfer belt 30. The blade provided with each is constantly in pressure contact and the adhered residual toner is removed and the circumferential surface is kept clean.

On the other hand, a transfer material P is ejected by the action of the sheet feeding roller 22B of a sheet feeding cassette (not shown); is supplied to a timing roller 23; is brought into synchronization with the transport of the color toner images on the intermediate transfer belt 30, and is transported to the transfer zone of the transfer roller 35.

The transfer roller 35 is brought into synchronization with the circumferential speed of the intermediate transfer belt 30; is rotated counterclockwise; the fed transfer material P is brought into close contact with the color toner images on the intermediate transfer belt 30 in the transfer zone formed by a nip section between the transfer roller 35 and the roller 33 in electrically grounded state, and the color toner images are successively transferred onto the transfer material P by application of a bias voltage having a polarity opposite to the toner of 1 to 2 kV to the transfer roller 35.

The transfer material P subjected to transfer of a color toner image is discharged; is conveyed to the fixing device 24 via a conveyance plate 36; is conveyed while being held between a heat roller 241 and a pressure contact roller 242; is heated to melt fix the toner, and after completing fixing, is ejected to the exterior of the apparatus via a sheet ejecting roller 25A.

Figure 11:
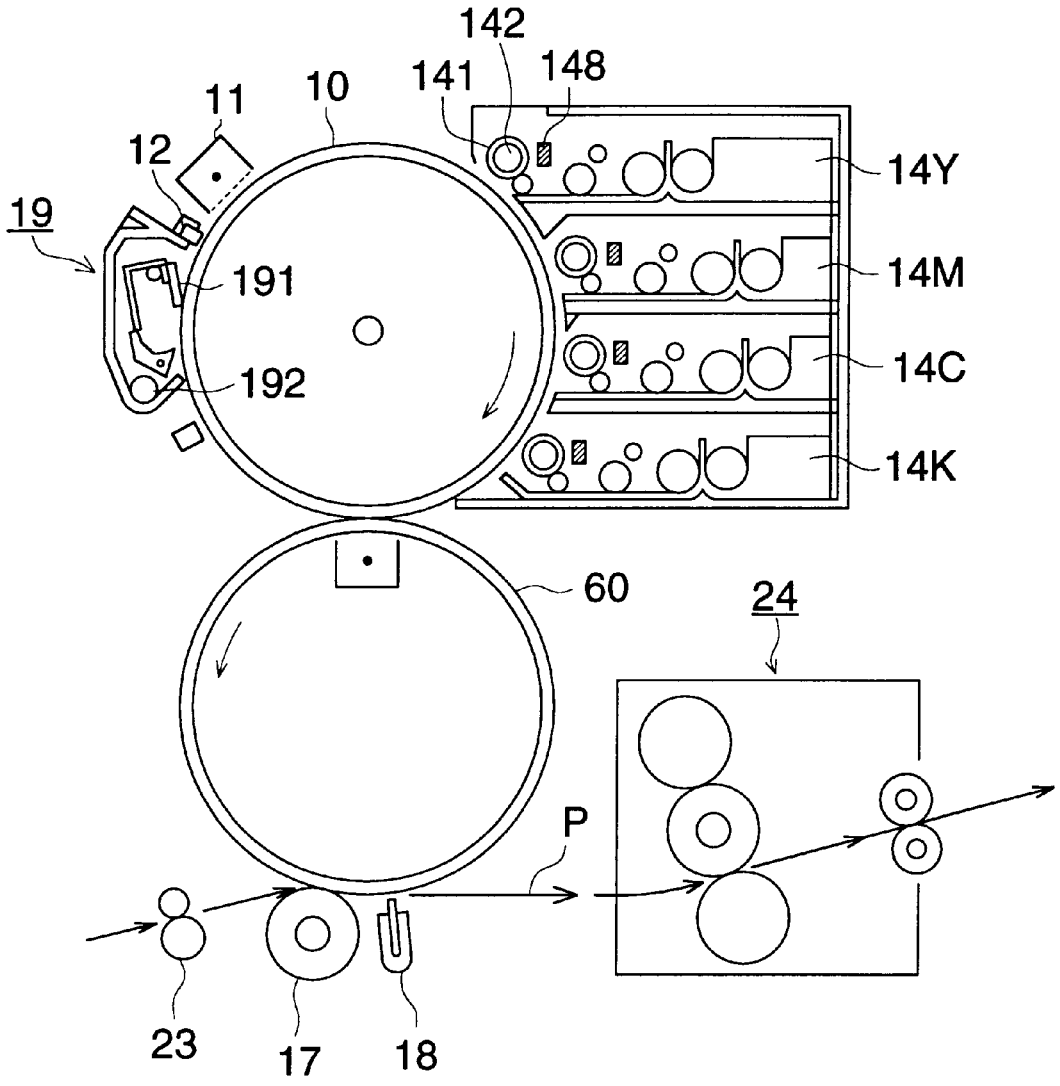
FIG. 11 is a sectional constitution view showing an embodiment of a color image forming apparatus in which an intermediate transfer drum is employed.

FIG. 11 is a sectional constitution view showing a color image forming apparatus employing an intermediate transfer drum 60. When this intermediate transfer drum 60 is employed, an electrostatic latent image formed on the rotating photoreceptor drum 10 is developed employing the development sleeve 141, the magnet roll 142 having the detaching magnetic pole, and the developer unit 14Y provided with the magnetic body 148 to form a Y color toner image and this Y color toner image is transferred to a intermediate transfer drum 60 from the photoreceptor drum 10. In the same manner as above, a C color toner image and a K color toner image are successively transferred to the intermediate transfer drum 60 from the photoreceptor drum 10. Furthermore, in the transfer zone where the intermediate transfer drum 60 and the transfer roller 17 are in contact with each other, multi-color toner images (Y, M, C, and K) are simultaneously transferred to the transfer material P, and thereafter, the resulting transfer material P is separated employing the separation means 18 and the image is fixed by the fixing device 24.

Figure 12:
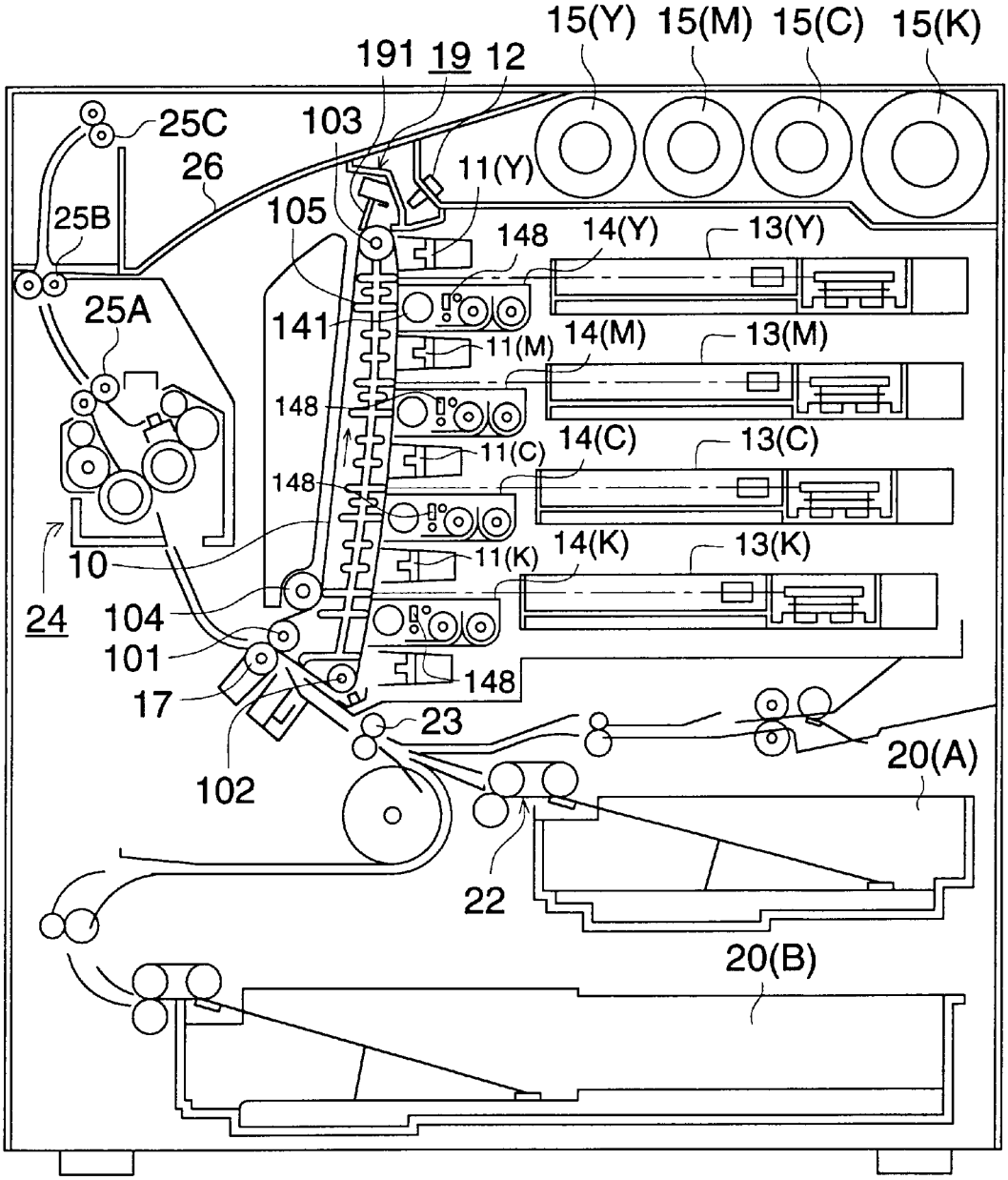
FIG. 12 is a sectional constitution view further showing another embodiment of a color image forming apparatus to which the development device of the present invention is applied.

FIG. 12 is a sectional constitution view of another embodiment of the color image forming apparatus to which the development device of the present invention is applied.

Further, regarding the reference numerals used in FIG. 12, a part which performs the same function as that in FIGS. 1 and 10 carries the same reference numeral. Points different from the above-mentioned embodiment are explained.

This color image forming apparatus is the same manner as in FIG. 10, around the image bearing body 10, a plurality of sets (four sets are shown in FIG. 12) are provided which are composed of a charging means 11 (Y, M, C, and K), an image exposure means 13 (Y, M, C, and K), and a development means 14 (Y, M, C, and K). However, as the image bearing body, a flexible endless belt shaped photoreceptor 10 (hereinafter referred to as belt photoreceptor) is employed and as a image exposure means 14 (Y, M, C, and K), a laser beam scanning optical device is employed.

The belt photoreceptor 10 is entrained about a drive roller 101, rotation rollers 102 and 103, and maintains tension by the action of a tensioning roller 104, and is moved around clockwise as shown, while being locally contacted employing a back up member 105 provided in the inner circumferential surface. The back up member 40 decides the development zone of the development sleeve 141 (Y, M, C, and K) and the focusing position of the image exposure means 13 (Y, M, C, and K).

Around the outer circumferential surface of the tensioned belt photoreceptor 10, image forming means are provided which are composed of four sets of charging means 11 (Y, M, C, and K), image exposure means 13 (Y, M, C, and K), and development means 14 (Y, M, C, and K).

Upon starting image recording, the drive motor rotates and the belt photoreceptor 10 is rotated clockwise as shown via the drive roller 101, and the application of electrical potential to the belt photoreceptor 10 is initiated by the charging action of a scorotron charging device 11(Y). After the belt photoreceptor 10 is charged, in the image exposure means 13(Y), exposure employing electrical signals corresponding to first color signals, that is, yellow (Y) image signals is initiated, and in accordance with the rotation (subscanning) of the belt, an electrostatic latent image corresponding to the yellow (Y) image of an original document is formed on the surface of the photosensitive layer. This latent image is subjected to reversal development employing the development unit 14(Y) in such a manner that a developer material transported and adhered onto the development sleeve 141(Y) is in a non-contact state, and in accordance with the rotation of the photoreceptor belt 10, an yellow (Y) toner image is formed.

Thereafter, the belt photoreceptor 10 is subjected to charging by the charging action of the scorotron charging device 11(M) on the yellow (Y) toner image; is subjected exposure employing electrical signals corresponding to the second color signals, that is, electrical signals corresponding to a magenta (M) image signals, and is subjected to reversal development in non-contact state, employing the development unit 14(M), and a magenta (M) toner image is superimposed on the above-mentioned yellow (Y) toner image.

In the similar processes as above, a cyan (C) toner image corresponding to third color signals is formed and superimposed on the previous image, and a black (K) toner image corresponding to fourth color signals is successively superimposed and formed employing the scorotron charging device 11(K), the image exposure means 13(K), and the development unit 14(K). Within one rotation of the belt photoreceptor 10, a color toner image is formed on the circumferential surface.

During development employing the development units 14(Y), 14(M), 14(C), and 14(K), a direct current or alternating current superposed direct current is applied to each of the development sleeves 141(Y), 141(M), 141(C), and 141 (K); non-contact development is carried out employing a single-component or two-component developer material adhered onto the development sleeve 141, and non-contact reversal development is carried out in that toner is adhered to the exposed part on the photoreceptor from the development sleeve 141 to which a direct current bias having the same polarity as that of the charge on the belt photoreceptor 10 for the belt photoreceptor 10 of which conductive layer is electrically grounded.

Thus, the color toner image formed on the circumferential surface of the photoreceptor drum 10 is subjected to equalization of potential of the adhered toner employing the scorotron 11(F), and is then subjected to charge elimination employing a pre-transfer exposure device; in the transfer section, a transfer sheet is ejected from a sheet feeding cassettes 20(A) and 20(B) as a sheet feeding device or from a manual feeding section; is transported to a pair of register rollers 23; by driving a pair of register rollers 23, the toner image is transferred onto the transfer sheet which is fed in synchronization with the toner image zone on the belt photoreceptor 10, by employing the transfer roller 17 which is arranged while facing the lower part of the drive roller 101 employed to drive the belt photoreceptor 10.

The transfer sheet subjected to the transfer of the toner images is separated from the circumferential surface of the belt photoreceptor 10 along the curvature of the drive roller 101; thereafter, is transported to a fixing device 24; is heated and pressed in the fixing device 24 to melt and fix the toners on the transfer sheet; is ejected from the fixing device 24; is conveyed by a pair of sheet ejecting rollers 25A, 25B, and 25C; is ejected to a sheet ejection tray 26 provided in the upper part while placing the toner image surface on the under surface.

On the other hand, the photoreceptor belt 10 from which a transfer sheet is separated is subjected to removal and cleaning of the remaining toner, while the surface of the photoreceptor belt is slid by a cleaning blade 191, and is continuously employed to form a toner image corresponding to the image of a subsequent original document or stands by temporarily. Further, when the formation of a toner image corresponding to the image of the subsequent original document is successively carried out, the photoreceptor surface of the belt photoreceptor 10 is subjected to exposure employing the pre-charging charge eliminating 12 which eliminates the hysteresis.

Each of development sleeves 141 of the above-mentioned development units 14 (Y, M, C, and K) also comprises a plurality of magnetic poles S1 to S3, and N1 to N4, as shown in FIG. 2, and among a plurality of these magnetic poles, a repulsive magnetic field is formed by the magnetic poles adjoining with another pole with the same polarity; the magnetic body 148 is provided, in non-contact state, near detaching magnetic poles N1 and N2, which detach the developer material on the development sleeve 141; by forming the repulsive magnetic field having the same polarity of that of the detaching magnetic poles N1 and N2, the developer material on the development sleeve 141 is detached to eliminate the image hysteresis on the development sleeve 141.

The present invention remarkably minimizes ghosting by forming a repulsive magnetic field in such a manner that magnetic bodies having the same polarity are faced with each other as a detaching pole which detaches the developer material from the development sleeve of a development device. The magnetic scraper technique employing this magnetic body, being provided in a non-contact state with the development sleeve, disadvantages such that a developer material is passed through the space between the development sleeve and the scraper employing the conventional technique of the scraper contact, degradation of the developer material when scraped and abrasion of the development sleeve are improved. Furthermore, the image forming apparatus of the present invention is neither subjected to decrease in charge amount nor decrease in image density, when many prints are continuously processed.

Furthermore, the present invention is that because a magnetic body of a detaching pole is not in contact with a development sleeve, the stainless steel (SUS) composed of the base body forming the outer circumference of the development sleeve may be replace with an aluminum alloy and thus, is effective in lowering the production cost and decreases the weight.

What is claimed is:

1. A development device for developing an electrostatic latent image formed on an image bearing body, said development device comprising:

(a) a developer bearing body for bearing a developer thereon and for conveying the developer to a developing area on said image bearing body;

(b) a plurality of magnetic poles provided inside said developer bearing body;

(c) a detaching magnetic pole having optional two adjoining poles among said plurality of magnetic poles which are arranged to have the same polarity as each other for forming a repulsive magnetic field to remove the developer on said developer bearing body; and (d) a magnetic body provided in the vicinity of and spaced away from said detaching magnetic pole, for forming a repulsive magnetic field having the same polarity as that of said detaching magnetic pole, wherein a center position of said magnetic body is disposed between an angle of 20° downstream and an angle of 20° upstream in a rotation direction of a developing sleeve of said developer bearing body with respect to a center of a portion where the developer on said developer bearing body is removed.

2. The development device of claim 1, wherein the electrostatic latent image formed on said image bearing body is developed by a charged toner conveyed on said developer bearing body.

3. The development device of claim 2 further comprising:

a transfer device for electrostatic-transferring the developed toner image onto a transfer material passing through between said image bearing body and said transfer device or between an intermediate transferring body and said transfer device; and a separation device provided downstream of said transfer device for separating the transfer material from said image bearing body or said intermediate transferring body.

4. The development device of claim 3, wherein said development device is a reverse development device in which the developer is adhered to a latent image portion where an electric charge has been eliminated by light beams from a uniform charging surface on said image bearing body.

5. The development device of claim 1, wherein non-contact development is conducted, wherein a biased electric field in which a direct current and an alternating current are superposed is applied to said developer bearing body, and the developer flies to said electrostatic latent image on said image bearing body, thereby developing said electrostatic latent image.

6. The development device of claim 1, wherein the developer comprises a magnetic carrier particle and a toner particle.

7. The development device of claim 1, wherein the outer diameter of said developer bearing body is not less than 8 mm and not more than 60 mm.

8. The development device of claim 3, wherein said development device includes a plurality of development devices having respectively different colored developers, a toner image in which a plurality of colored images are superimposed is formed on said image bearing body, and then the superimposed toner image is concurrently transferred by said transfer device onto the transfer material to form a color image.

9. The development device of claim 1, wherein said magnetic body is a flat shaped board.

10. The development device of claim 3, wherein the outer diameter is not less than 8 mm and not more than 60 mm.

11. The development device of claim 3, wherein said magnetic body is a flat shaped board.

12. A method for developing a latent image on a developer bearing body to bear and convey a developer thereon in a developing area where said developer bearing body and an image bearing body are disposed to face each other, said method comprising:

(a) providing a plurality of magnetic poles inside said developer bearing body;

(b) arranging a detaching magnetic pole having optional two adjoining poles among said plurality of magnetic poles which have the same polarity as each other, thereby forming a repulsive magnetic field to remove the developer on said developer bearing body; and (c) providing a magnetic body in the vicinity of and spaced away from said detaching magnetic pole to form a repulsive magnetic field having the same polarity as that of said detaching magnetic pole, thereby removing the developer on said developer bearing body, wherein a center portion of said magnetic body is disposed between an angle of 20° downstream and an angle of 20° upstream in a rotation direction of a developer sleeve of said developer bearing body with respect to a center of a portion where the developer on said developer bearing body is removed.

* * * * *